US011325735B1

(12) United States Patent
Hockin et al.

(10) Patent No.: US 11,325,735 B1
(45) Date of Patent: May 10, 2022

(54) METHODS OF USING ADJUSTABLE PACKAGING

(71) Applicant: Amazon Technologies, Inc., Seattle, WA (US)

(72) Inventors: Chad Hockin, Seattle, WA (US); Naveen Aggarwal, Issaquah, WA (US); Justine Lea Mahler, Seattle, WA (US); Mike Custer, St. Charles, IL (US); Jenna Walsh, St. Charles, IL (US)

(73) Assignee: Amazon Technologies, Inc., Seattle, WA (US)

( * ) Notice: Subject to any disclaimer, the term of this patent is extended or adjusted under 35 U.S.C. 154(b) by 566 days.

(21) Appl. No.: 15/666,956

(22) Filed: Aug. 2, 2017

(51) Int. Cl.

| | |
|---|---|
| ***B65B 61/20*** | (2006.01) |
| ***B65D 77/26*** | (2006.01) |
| ***B65B 7/16*** | (2006.01) |
| ***B65D 81/133*** | (2006.01) |
| ***B65D 85/30*** | (2006.01) |

(52) U.S. Cl.
CPC ..... *B65B 61/20* (2013.01); *B65B 7/16* (2013.01); *B65D 77/26* (2013.01); *B65D 81/133* (2013.01); *B65D 85/30* (2013.01)

(58) Field of Classification Search
CPC ..... B65B 61/20; B65D 77/046; B65D 77/26; B65D 81/113; B65D 81/133; B65D 5/00; B65D 5/49; B65D 5/484; B65D 5/485; B65D 5/503; B65D 5/4266
USPC ..... 53/449
See application file for complete search history.

(56) References Cited

U.S. PATENT DOCUMENTS

| | | | | |
|---|---|---|---|---|
| 4,019,672 | A * | 4/1977 | Giannini | B65D 5/5069 206/592 |
| 5,167,606 | A * | 12/1992 | Kuchenbecker | B65D 5/06 493/160 |
| 5,685,431 | A * | 11/1997 | Chambers | B65D 5/4212 206/223 |
| 8,627,958 | B2 * | 1/2014 | McDonald | B65D 5/22 206/583 |
| 10,035,638 | B1 * | 7/2018 | LeRoy | B65D 5/5035 |
| 2010/0140333 | A1 * | 6/2010 | Mcdonald | B65D 5/22 229/117.01 |
| 2016/0101923 | A1 * | 4/2016 | Costanzo, Jr. | B65D 5/4266 206/583 |

(Continued)

OTHER PUBLICATIONS http://sunriseboxes.com/services/custom-inserts/, Wayback dated Oct. 26, 2016, PDF attached (Year: 2016).*

*Primary Examiner* — Anna K Kinsaul
*Assistant Examiner* — Daniel Jeremy Leeds
(74) *Attorney, Agent, or Firm* — BakerHostetler

(57) ABSTRACT

A packing insert includes a panel that defines a periphery, a location inward of the periphery, and a plurality of flaps each defining an outer end and an inner end such that each flap extends inwardly from its outer end to its inner end. Each of the flaps is foldable about its outer end so that the flaps collectively define a void. A first one of the flaps has a second outer end spaced outwardly from the outer end of the first flap. The panel defines at least one frangible portion between the outer end and the second outer end of the first flap. The first flap is selectively foldable about 1) its outer end so as to at least partially define the void, and 2) its second outer end, after breaking the at least one frangible portion, so as to increase a size of the void.

13 Claims, 11 Drawing Sheets

(56) References Cited

U.S. PATENT DOCUMENTS

2018/0290787 A1* 10/2018 McDonald ..... B65D 5/241
2018/0327164 A1* 11/2018 Kiessner ..... B65D 81/075

* cited by examiner

METHODS OF USING ADJUSTABLE PACKAGING

BACKGROUND

For certain categories of consumer electronic devices, particularly handheld electronic devices, such as smartphones, tablet computers, laptops, and e-readers, for example, the electronic devices within each category are generally manufactured within predictable (i.e., ergonomic) size ranges. The foregoing handheld electronic devices are each typically rectangular in shape and have a thickness that is relatively thin compared to its length and width. In material handling facilities, such as order fulfillment centers, handheld electronic devices can be stored, ordered, sorted, and packaged for delivery to the customer. In fulfillment centers, orders can be processed new as well as refurbished electronic devices. In many instances, to package a refurbished electronic device for shipping (or otherwise delivering) to the customer, an operator will select a pre-sized packaging insert that defines a space or void sized to receive the electronic device therein. The operator will prepare the insert (such as by folding, for example) for receiving the electronic device, place the insert in an outer box, place the electronic device in the void in the insert (optionally with a packing filler as needed for protecting the device during delivery), and seal the outer box for shipping.

BRIEF DESCRIPTION OF THE DRAWINGS

The following detailed description will be better understood when read in conjunction with the appended drawings, in which there is shown in the drawings example embodiments for the purposes of illustration. It should be understood, however, that the present disclosure is not limited to the precise arrangements and instrumentalities shown. In the drawings.

DETAILED DESCRIPTION

Figure 1:
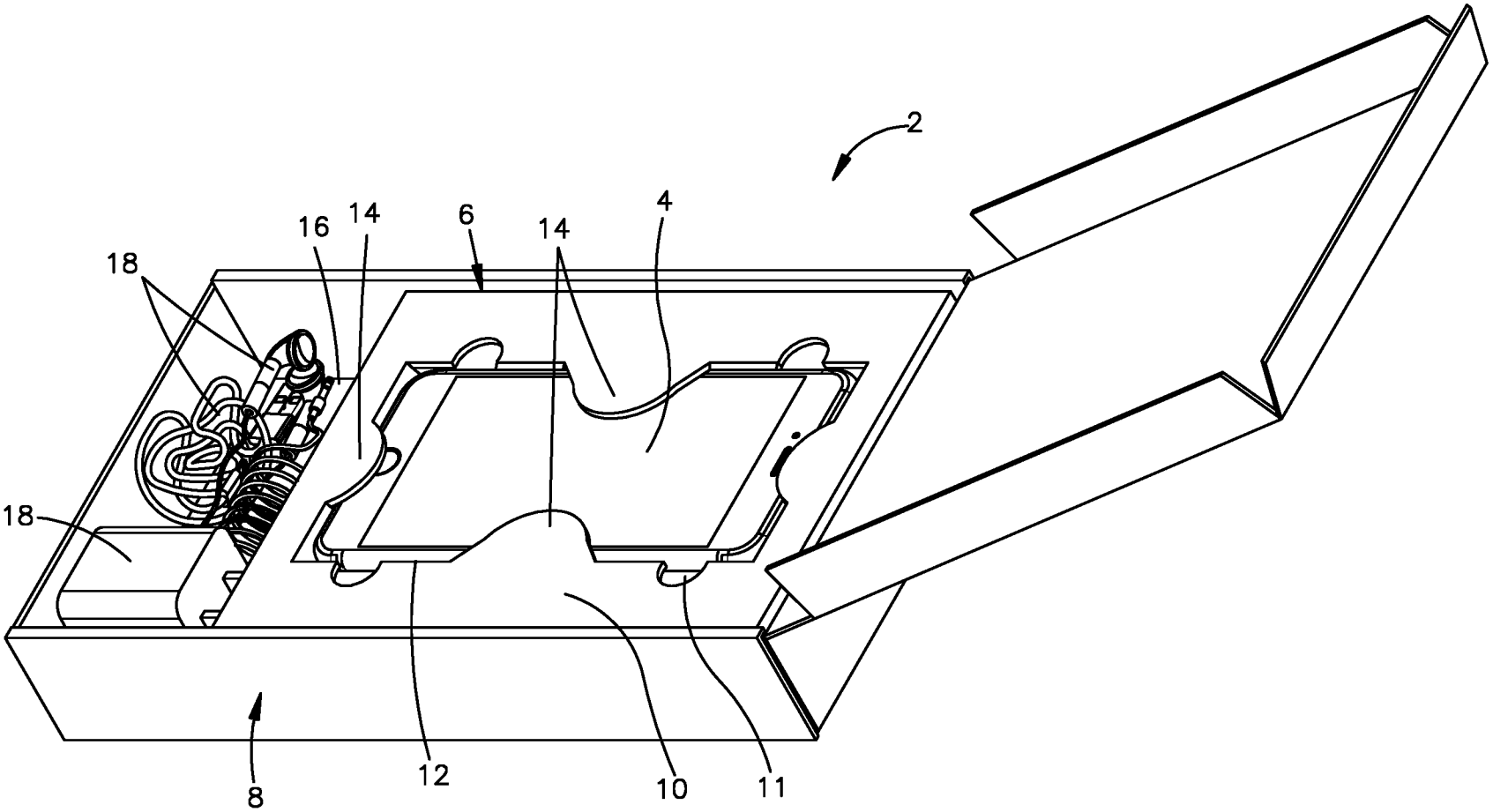
FIG. 1 shows a perspective view of a package assembly for an electronic device, according to an embodiment of the present disclosure.

In the illustrated embodiments set forth herein, a packaging insert 6 accepts smartphones 4 (and the like) of various lengths, widths, and thicknesses. Different smartphone lengths D1, D2, D3 are accommodated by opposed end flaps 50, 52 each defining bend-enhancing portions 86, 87, 88 such that each end flap 50, 52 is chosen to be folded at one of the bend-enhancing portions 86, 87, 88 to adjust the length of a void 12 in the insert 6 for holding the smartphone 4 therein, as desired. Different smartphone widths W4, W5 are accommodated by opposed side flaps 90, 92 each defining bend-enhancing portions 120, 122 such that each side flap 90, 92 is chosen to be folded at one of the bend-enhancing portions 120, 122 to adjust the width of the void 12, as desired. Different smartphone thicknesses are accommodated at least by the side flaps 90, 92, each of which can be molded around the sides of the smartphone 4 and can extend obliquely to a bottom panel of an outer box 8 in which the insert 6 is placed.

Referring now to FIG. 1, a package assembly 2 for an electronic device 4 can include a package insert 6 contained within an outer box 8. The insert 6 can be configured to receive and carry the electronic device 4 therein. As shown, the insert 6 can include a main panel 10 that defines a receiving portion 11 for receiving the electronic device 4 therein. The electronic device 4 can be a handheld electronic device, such as a smartphone, as shown, or other handheld electronic devices, such as tablet computers, laptops, and e-readers, by way of non-limiting examples. The receiving portion 11 of the main panel 10 can define a space or void 12 sized to snugly receive the electronic device 4 therein. The main panel 10 can define retention elements 14 that extend over or otherwise overlap at least a portion of the electronic device 4 in a manner retaining the electronic device 4 in the void 12. The insert 6 can also include an accessory panel 16 configured to define an additional space for storing accessories 18 for the electronic device 4, such as power cords, chargers, earphones, and wireless transmitters and receivers, for example. Thus, the additional space can be referred to as an "accessory space."

The receiving portion 11 is adjustable so that the void 12 can have a variable size, particularly both a variable length and a variable width, to accommodate electronic devices 4 of various sizes. Thus, the insert 6 provides advantages over prior art inserts. In particular, a single insert 6 configured as disclosed herein can be used to package a wider range of electronic devices 4, reducing the amount of differently configured inserts that would otherwise be necessary to package a subset of electronic devices 4 having different sizes. It is to be appreciated that the insert 6 can be scaled larger or smaller so as to accommodate an even wider range of electronic devices 4. It is also to be appreciated that the insert 6 as set forth herein can also be used for packaging items other than electronic devices, such as books, by way of non-limiting example, or even non-rectangular items.

Figure 2:
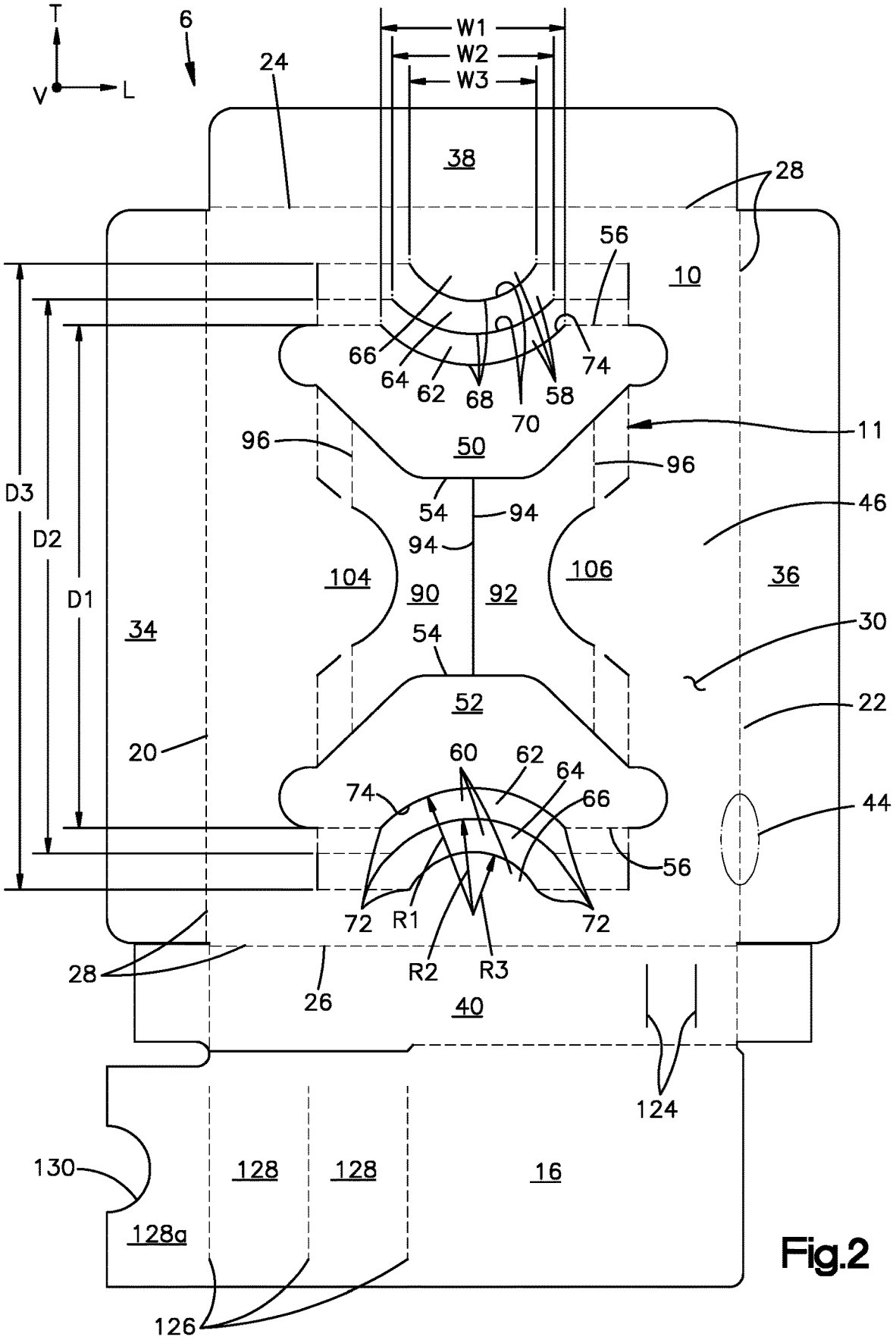
FIG. 2 shows a plan view of an insert of the package assembly of FIG. 1, wherein the insert is shown in an initial configuration, according to an embodiment of the present disclosure.
Figure 7:
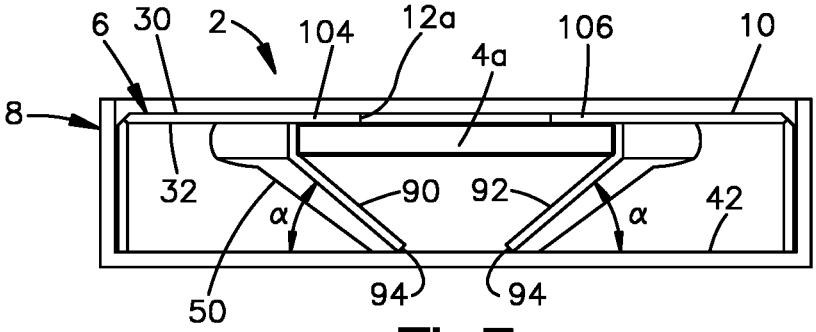
FIG. 7 shows a sectional end view of the insert and the first electronic device, taken along section line 7-7 of FIG. 6.

Referring now to FIG. 2, a top view of the insert 6 is shown in an initial configuration, in which the insert 6 is shown in its flat, die cut configuration. The insert 6 can be formed as a single piece of packaging material, such as paperboard, corrugated fiberboard, also referred to as "corrugated board", other paper-based board materials, or a plastic, by way of non-limiting example. It is to be appreciated that the main insert 10 and the outer box 8 can each be formed of a material that is completely recyclable. The main panel 10 of the insert 6 can have a first side 20 and a second side 22 spaced from each other along a lateral direction L and a first end 24 and a second end 26 spaced from each other along a transverse direction T that is substantially perpendicular to the lateral direction L. The lateral and transverse directions L, T can define a horizontal plane. It is to be appreciated that any plane extending along the lateral and transverse directions L, T can be characterized as a horizontal plane. Additionally, as used herein, the term "horizontal" means extending along the horizontal plane. The first and second sides 20, 22 and first and second ends 24, 26 can each define a peripheral edge of the main panel 10. Thus, the first and second sides 20, 22 and first and second ends 24, 26 can collectively define a periphery 28 of the main panel 10. Each of the first and second sides 20, 22 and first and second ends 24, 26 can be linear and can be oriented to provide the main panel 10 with a rectangular shape, although other shapes are within the scope of the present disclosure. The main panel 10 can define a top surface 30 and a bottom surface 32 (while not visible in FIG. 2, the bottom surface 32 is shown in FIG. 7) on opposite sides of the main panel 10 with respect to a vertical direction V that is substantially perpendicular to the lateral and transverse directions L, T. It is to be appreciated that, in the view of FIG. 2, the vertical direction V extends orthogonally into and out of the page. The main panel 10 can define a thickness between the top and bottom surfaces 30, 32 thereof along the vertical direction V.

It is to be appreciated that the lateral, transverse, and vertical directions L, T, V is each bi-directional. As used herein, the terms "lateral" and "laterally" mean along the lateral direction L; the terms "transverse" and "transversely" mean along the transverse direction T; and the terms "vertical" and "vertically" mean along the vertical direction V. Additionally, as used herein, the terms "up" and "upward" refer to the mono-directional component of the vertical direction V by which the top surface 30 is spaced from the bottom surface 32 of the main panel 10; and the terms "down" and "downward" refer to the opposite mono-directional component of the vertical direction V (i.e., by which the bottom surface 32 is spaced from the top surface 30 of the main panel 10).

The insert 6 can include a first sidewall panel 34 extending outwardly from the first side 20 of the main panel 10 along the lateral direction L and a second sidewall panel 36 extending outwardly from the second side 22 of the main panel 10 along the lateral direction L. The insert 6 can also include a first endwall panel 38 extending outwardly from the first end 24 of the main panel 10 along the transverse direction T and a second endwall panel 40 extending outwardly from the second end 26 of the main panel 10 along the transverse direction T. The accessory panel 16 can extend outward from the second endwall panel 40 along the transverse direction T. The second endwall panel 40 and the accessory panel 16 can cooperatively define the accessory space, and each can include features for storing accessories 18, as set forth in more detail below.

The first side 20 of the main panel 10 can define a boundary between the main panel 10 and the first sidewall panel 34. The second side 22 of the main panel 10 can define a boundary between the main panel 10 and the second sidewall panel 36. The first end 24 of the main panel 10 can define a boundary between the main panel 10 and the first endwall panel 38. The second end 26 of the main panel 10 can define a boundary between the main panel 10 and the second endwall panel 40. The insert 6 can define a bend-enhancing feature extending along each of the first and second sides 20, 22 and first and second ends 24, 26 of the main panel 10 so that the sidewall panels 34, 36 and endwall panels 38, 40 are each foldable along their respective boundary with the main panel 10. In this manner, the sidewall panels 34, 36 and endwall panels 38, 40 can be folded orthogonally with respect to the main panel 10 so that that the main panel 10 will be elevated above the main support surface 42 (of the bottom panel) of the outer box 8 (see FIG. 7) when the insert 6 is placed within the outer box 8. In the illustrated embodiment, the bend-enhancing feature includes scoring 44 defined along the first and second sides 20, 22 and first and second ends 24, 26 of the main panel 10. However, in other embodiments, the bend-enhancing features along the sides and ends of the main panel 10 can include pre-formed creases, areas of reduced insert 6 thickness, and weakened areas of the insert 6, by way of non-limiting example.

The receiving portion 11 of the main panel 10 can define a geometric center X. In the illustrated embodiment, the geometric center X of the receiving portion 11 is substantially coincident with a geometric center of the main panel 10 with respect to the lateral and transverse directions L, T. It is to be appreciated, however, that the receiving portion 11 need not be centered in such a manner.

As used herein with reference to any location on the main panel 10, the term "external direction" means any direction that is mono-directional and defines a ray that: (1) has an endpoint coincident with the location; and (2) is oriented such that a linear distance between a point on the ray and the geometric center X of the receiving portion 11 increases as the point moves along the ray away from the endpoint. Additionally, as used herein with reference to any location on the main panel 10, the term "internal direction" means any direction that is mono-directional and defines a ray that: (1) has an endpoint coincident with the location; and (2) is oriented such that a linear distance between a point on the ray and the geometric center X of the receiving portion 11 decreases as the point moves along the ray away from the endpoint. As used herein, the terms "inner", "inward", and "inwardly" are made with reference to the "internal direction" defined as set forth above. Similarly, as used herein, the terms "outer", "outward", and "outwardly" are made with reference to the "external direction" defined as set forth above.

The receiving portion 11 of the main panel 10 can be inward of the periphery 28. As shown, the receiving portion 11 can be inward of the entire periphery 28 of the main panel 10. In other embodiments (not shown), the receiving portion 11 can be inward from less than all of the peripheral edges (i.e., sides 20, 22, 24, 26) of the main panel 10. The main panel 10 can define a peripheral region 46 extending between the periphery 28 and the receiving portion 11.

The receiving portion 11 of the main panel 10 can define a plurality of receiving members that are adjustable to increase the size of the void 12, such as when an electronic device 4 of large size is to be placed in the insert 6. In the illustrated embodiment, the receiving members include a first end flap 50 and a second end flap 52 spaced from each other along the transverse direction T. The first and second end flaps 50, 52 can extend inwardly toward each other. The receiving members can also include a first side flap 90 and a second side flap 92 spaced from each other along the lateral direction L and extending inwardly toward each other. Each of the end flaps 50, 52, can define a free inner end 54 and an outer end 56 that is integral with the main panel 10. Each of the side flaps 90, 92 can also define a free inner end 94 and an outer end 96 that is integral with the main panel 10. The inner ends 94 of the first and second side flaps 90, 92 can abut one another when the insert 6 is in the initial configuration. However, in other embodiments, the inner ends 94 of the first and second side flaps 90, 92 can be separated by a gap when in the insert 6 is in the initial configuration. In the illustrated embodiment, the outer end 56 of each end flap 50, 52 is a first outer end thereof, and the outer end 96 of each side flap 90, 92 is a first outer end thereof. As discussed in more detail below, each end flap 50, 52 and each side flap 90, 92 can have an additional outer end that is spaced from the first outer end 56, 96 in an external direction.

With continued reference to FIG. 2, the receiving portion 11 of the main panel 10 can define the retention elements 14. In the illustrated embodiment, the retention elements 14 are tabs, although other structures can be employed. The tabs can be arcuate in shape and can be convex in an internal direction. The tabs can include a first series of end tabs 58 spaced from the first end flap 50 in an exterior direction and a second series of end tabs 60 spaced from the second end flap 52 in an exterior direction. Each of the first and second series of end tabs 58, 60 can include an inner tab 62, an outer tab 66, and an intermediate tab 64 positioned between the innermost and outer tabs 62, 66. Each tab of the first and second series of end tabs 58, 60 can define an inner edge 68, while the inner tab 62 and intermediate tab 64 of each series can define an outer edge 70 spaced from the respective inner edge 68 of the tab thereof along an external direction. The inner edge 68 of each tab of the first and second series of end tabs 58, 60 can extend outwardly from a tab apex to outer termini 72 located on each lateral side of the respective tab.

The inner edge 68 of the inner tab 62 can define a first radius R1; the inner edge 68 of the intermediate tab 64 can define a second radius R2, and the inner edge 68 of the outer tab 66 can define a third radius R3. The outer termini 72 of the inner tab 62 can define a first width W1 along the lateral direction L; the outer termini 72 of the intermediate tab 64 can define a second width W2 along the lateral direction L; and the outer termini 72 of the outer tab 66 can define a third width W3 along the lateral direction L. As shown, in each series of end tabs 58, 60, the tabs 62, 64, 66 thereof can be nested with respect to each other along the transverse direction T. Accordingly, the first width W1 can be greater than the second width W2; the second width W2 can be greater than the third width W3; the first radius R1 can be greater than the second radius R2; and the second radius can be greater than the third radius R3.

In the first and second series of end tabs 58, 60, the inner edge 68 of the inner tab 62 can abut an edge, such as an outward edge 74, of the respective first or second end flap 50, 52 at least when the insert 6 is in the initial configuration. Similarly, in each series of end tabs 58, 60, the inner edge 68 of the intermediate tab 64 can abut the outer edge 70 of the inner tab 62, and the inner edge 68 of the outer tab 66 can abut the outer edge 70 of the intermediate tab 64 at least when the insert 6 is in the initial configuration. The inner tabs 62 of the first and second series of end tabs 58, 60 can be spaced from each other so as to define a first distance D1, measured between the respective outer termini 72 of the inner tabs 62 along the transverse direction T. The intermediate tabs 64 of the first and second series of end tabs 58, 60 can be spaced from each so as to define a second distance D2, measured between the respective outer termini 72 of the intermediate tabs 64 along the transverse direction T. The outer tabs 66 of the first and second series of end tabs 58, 60 can be spaced from each other so as to define a third distance D3, measured between the respective outer termini 72 of the outer tabs 66 along the transverse direction T.

Figure 3:
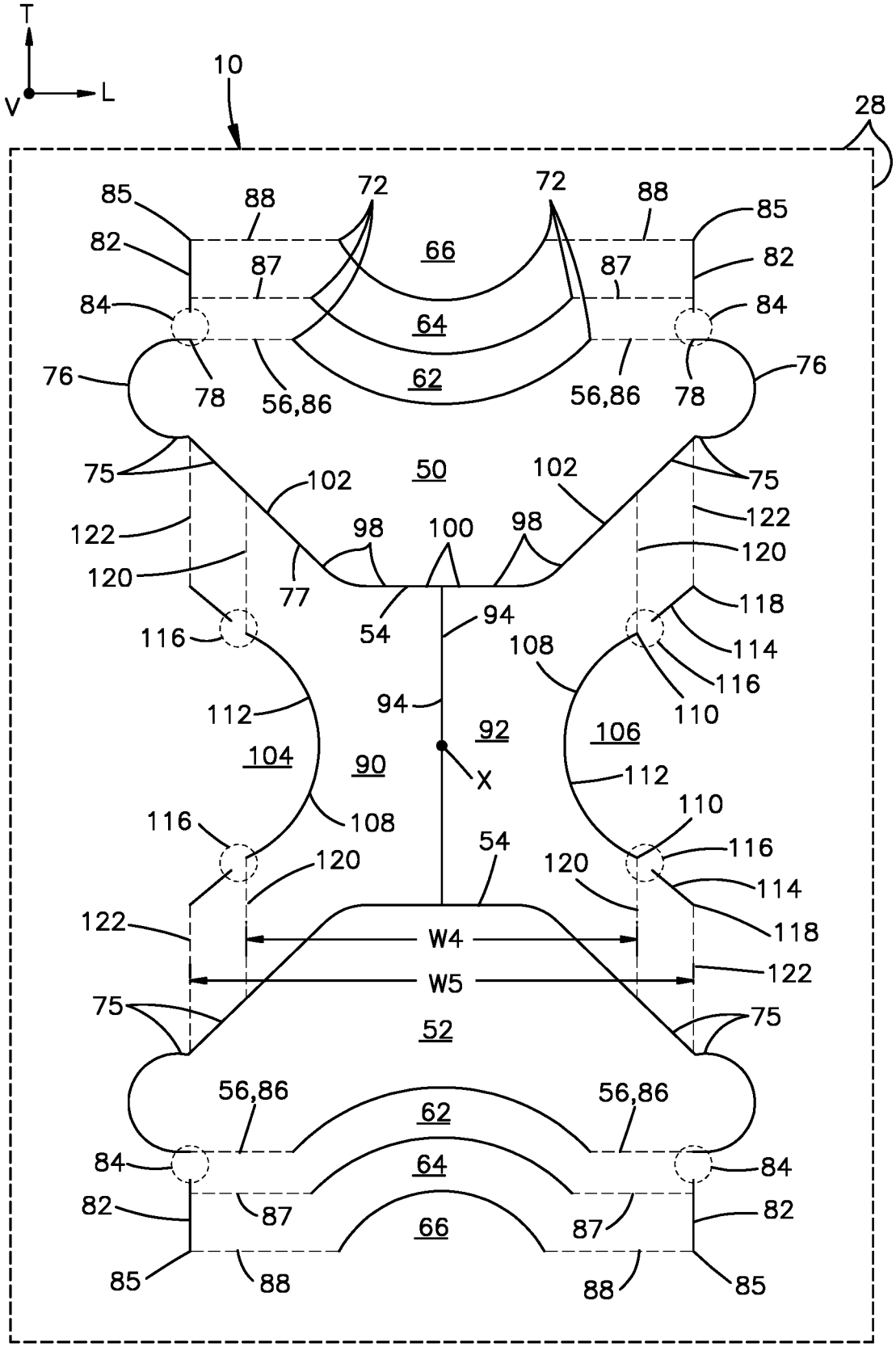
FIG. 3 shows an enlarged plan view of a main panel of the insert of FIG. 2 in the initial configuration.

Referring now to FIG. 3, an enlarged view of the main panel 10 is shown in the initial configuration. Each of the first and second end flaps 50, 52 can define opposed lateral sides 75 that each extend from the first outer end 56 to the inner end 54 of the respective end flap 50, 52. Each lateral side 75 can define an outwardly extending side protrusion 76 at the first outer end 56 of the respective flap. The side protrusions 76 can be arcuate and laterally convex, as shown. The lateral sides 75 of the first and second end flaps 50, 52 can also define a taper portion 77 wherein the lateral sides 75 taper inwardly from the side protrusions 76 to the inner end 54 of the flap. As shown, the lateral sides 75 of the first and second end flaps 50, 52 can taper linearly, although in other embodiments the lateral sides can taper in an arcuate manner in the taper portion 77. Outer termini 78 of the side protrusions 76 of each of the first and second end flaps 50, 52 can be aligned with the outer termini 72 of the inner tab 62 of the respective first or second series of end tabs 50, 52 along the lateral direction L (i.e., a straight line oriented along the lateral direction L can intersect the outer termini 78 of the side protrusions 76 of the end flap and the outer termini 72 of the inner tab 62).

The first and second side flaps 90, 92 can each define opposed transverse sides 98 that extend from the outer end 96 to the inner end 94 of the respective side flap 90, 92. The transverse sides of each side flap 90, 92 can define a parallel portion 100 in which the transverse sides of the side flap 90, 92 are parallel. The parallel portion 100 of each side flap 90, 92 can be adjacent the inner end 94 thereof. The transverse sides 98 of each side flap 90, 92 can also define a tapered portion 102 in which the transverse sides 98 taper outwardly from the parallel portion 100. As shown, when the insert 6 is in the initial configuration, the parallel portions 100 of the side flaps 90, 92 can abut the inner ends 54 of the end flaps 50, 52 and the tapered portions 102 of the side flaps 90, 92 can abut the tapered portions 77 of the end flaps 50, 52. In the initial configuration, the parallel portions 100 of the side flaps 90, 92 can be positioned between the inner ends 54 of the end flaps 50, 52.

The receiving portion 11 can also define a first side tab 104 positioned outward of the inner end 94 of the first side flap 90. The receiving portion 11 can also define a second side tab 106 positioned outward of the inner end 94 of the second side flap 92. The first and second side tabs 104, 106 can each be arcuate and inwardly convex. Each of the first and second side tabs 104, 106 can include an inner edge 108 that extends outwardly from an apex to edge termini 110. The inner edges 108 of the first and second side tabs 104, 106 can abut an edge, such as an outward edge 112, of the respective first or second side flap 90, 92, at least when the insert 6 is in the initial configuration.

It is to be appreciated that each of the flaps 50, 52, 90, 92 and tabs 62, 64, 66, 104, 106 of the main panel 10 can be defined by cuts formed vertically through the main panel 10 (i.e., from the top surface 30 to the bottom surface 32 thereof). For example, within each series of end tabs 58, 60, the convex inner edge 68 of the inner tab 62 and the outward edge 74 of the end flap 50, 52 can be defined by the same cut formed vertically through the main panel 10. Similarly, within each series of end tabs 58, 60, the outer edge 70 of the inner tab 62 and the inner edge 68 of the intermediate tab 64 can be defined by the same cut formed vertically through the main panel 10. Additionally, the outer edge 70 of the intermediate tab 64 and the inner edge 68 of the outer tab 66 in each series can be defined by the same cut formed vertically through the main panel 10. For each side tab 104, 106, the convex inner edge 108 of the side tab 104, 106 and the outward edge 112 of the associated side flap 90, 92 can be defined by the same cut formed vertically through the main panel 10. Moreover, for each end flap 50, 52, the lateral sides 75 (including the side protrusions 76 and the tapers) and the inner end 54 can be defined by a single, continuous cut formed vertically through the main panel 10, which cut can also define the adjacent transverse sides 98 of the first and second side flaps 90, 92 (including the tapered portions 102 and parallel portions 100 thereof).

The receiving portion 11 of the main panel 10 can also define extension features configured to selectively extend at least one of the end flaps 50, 52 and side flaps 90, 92 in an external direction. For example, for each end flap 50, 52, the extension features can include a pair of end extension cuts 82 spaced outwardly from the first outer end 56 of the end flap 50, 52 so as to define a frangible portion 84, referred to herein as a "nick", of the main panel 10 therebetween. The end extension cuts 82 associated with each end flap 50, 52 can each be linear and can each extend along the transverse direction T, although other orientations are within the scope of the present disclosure. The end extension cuts 82 can be aligned with the outer termini 78 of the side protrusions 76 of the end flap 50, 52 along the transverse direction T so that the respective end nicks 84 defined therebetween, once broken, cause the lateral sides 75 of the end flap 50, 52 to be continuous with the end extension cuts 82. In this manner, the end extension cuts 82 can define respective portions of the lateral sides 75 of the end flaps 50, 52. Additionally, once the end nicks 84 are broken, outer termini 85 of the pair of end extension cuts 82 define a second outer end of the end flap 50, 52. Preferably, outer termini 85 of the end extension cuts 82 are aligned with the outer termini 72 of the outer tab 66 of the associated series of end tabs 58, 60 along the lateral direction L, although other configurations are within the scope of the present disclosure.

The extension features can also include pair of side extension cuts 114 associated with each of the side flaps 90, 92. Each pair of side extension cuts 114 can be spaced outwardly from the outer ends 96 of the associated side flap 90, 92 so as to define frangible side nicks 116 therebetween. The side extension cuts 114 can each be linear and can each extend along an external direction that is offset from the lateral direction L, although other orientations are within the scope of the present disclosure. The side extension cuts 114 can be aligned with the outer termini 78 of the side protrusions 76 of the end flap 50, 52 along the foregoing respective external directions and can be configured such that, once the side nicks 116 are broken, outer termini 118 of the pair of side extension cuts 114 define a second outer end of the respective side flap 90, 92. Preferably, the outer termini 118 of the side extension cuts 114 are aligned with the end extension cuts 82 along the transverse direction T.

In the illustrated embodiment, the end flaps 50, 52 and the side flaps 90, 92 are configured to fold in predictable ways when depressed so as to define the void 12 for receiving the electronic device 4. In particular, the geometry of the flaps 50, 52, 90, 92, tabs 62, 64, 66, 104, 106, and extension cuts 82, 114 can define bend-enhancing portions in the main panel 10. For example, for each end flap 50, 52, the main panel 10 can define a first or innermost bend-enhancing portion 86, a second or intermediate bend-enhancing portion 87, and a third or outermost bend-enhancing portion 88. The first bend-enhancing portion 86 can extend laterally from each lateral side of the inner tab 62. Preferably, on each lateral side of the inner tab 62, the first bend-enhancing portion 86 extends laterally from the outer terminus 78 of the side protrusion 76 to the adjacent outer terminus 72 of the inner edge 68 of the inner tab 62. In the illustrated embodiment, the first bend-enhancing portion 86 defines the first outer end 56 of the end flap 50, 52. The second bend-enhancing portion 87 can extend laterally from each lateral side of the intermediate tab 64. Preferably, on each lateral side of the intermediate tab 64, the second bend-enhancing portion 87 extends laterally from the end extension cut 82 to the adjacent outer terminus 72 of the inner edge 68 of the intermediate tab 64. The third bend-enhancing portion 88 can extend laterally from each lateral side of the outer tab 66. Preferably, on each lateral side of the outer tab 66, the third bend-enhancing portion 88 extends laterally from the outer terminus 85 of the end extension cut 82 to the adjacent outer terminus 72 of the inner edge 68 of the outer tab 66. In the illustrated embodiment, the third bend-enhancing portion 88 defines the second outer end of the end flap 50, 52.

It is to be appreciated that, in each series of end tabs 58, 60 in the illustrated embodiment, the outer tab 66 extends inwardly from the second outer end 88 of the respective end flap 50, 52, and the inner tab 62 extends inwardly from the first outer end 56 of the respective end flap 50, 52. Thus, in such embodiments, each series of tabs 58, 60 can be characterized as being defined by the respective end flap 50, 52.

Additionally, for each side flap 90, 92, the main panel 10 can define a fourth or inner bend-enhancing portion 120 and a fifth or outer bend-enhancing portion 122. The fourth bend-enhancing portion 120 can extend transversely from each transverse side of the side tab 104, 106. Preferably, on each transverse side of the side tab 104, 106, the fourth bend-enhancing portion 120 extends transversely from the outer terminus 110 of the inner edge 108 of the side tab 104, 106 to the lateral side of the side flap 90, 92. As shown, the fourth bend-enhancing portion 120 can intersect the tapered portion 102 of the transverse side 98 of the side flap 90, 92. In the illustrated embodiment, the fourth bend-enhancing portion 120 defines the first outer end 96 of the side flap 90, 92. The fifth bend-enhancing portion 122 can extend transversely outward from each of the side extension cuts 114 to the outer ends of the tapered portions 102 of the transverse sides 98 of the associated side flap 90, 92. In the illustrated embodiment, the fifth bend-enhancing portion 122 defines the second outer end of the associated side flap 90, 92. The fourth bend-enhancing portion 120 of the first side flap 90 can be spaced from the fourth bend-enhancing portion 120 of the second side flap 92 by a fourth width W4, measured along the lateral direction L. The fifth bend-enhancing portion 122 of the first side flap 90 can be spaced from the fifth bend-enhancing portion 122 of the second side flap 92 by a fifth width W5, measured along the lateral direction L.

With reference to FIGS. 4 through 16, manipulation of the receiving portion 11 of the main panel 10 in a modular manner to receive therein electronic devices 4 of varying sizes will now be discussed. It is to be appreciated that the receiving members 50, 52, 90, 92 and retention elements 62, 64, 66, 104, 106 of the main panel 10 can be cooperatively pre-configured to selectively define voids 12 of varying, predetermined sizes according to the dimensions of particular electronic devices. FIGS. 4 through 8 illustrate the insert 6 manipulated into a first operative configuration to receive a small-sized, or "small", electronic device 4*a*; FIGS. 9 through 12 illustrate the insert 6 manipulated into a second operative configuration to receive a medium-sized, or "medium", electronic device 4*b*; and FIGS. 13 through 16 illustrate the insert 6 manipulated into a third operative configuration to receive a large-sized, or "large", electronic device 4*c*.

Figure 4:
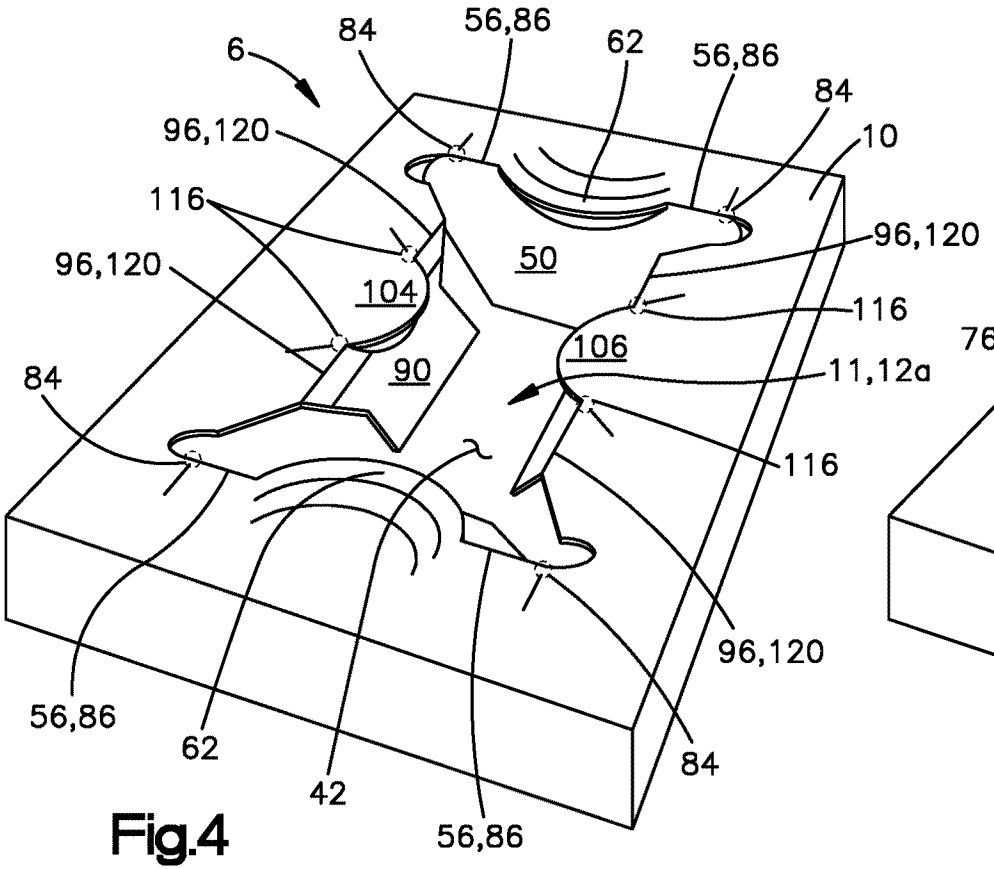
FIG. 4 shows a perspective view of the insert of FIG. 2 in a first operative configuration.

Referring to FIG. 4, when it is desired to reconfigure the receiving portion 11 into the first operative configuration (for receiving the small electronic device 4*a* therein), an operator can depress the end flaps 50, 52 and side flaps 90, 92 while maintaining the end nicks 84 and side nicks 116 in-tact. In this manner, the operator can manipulate both end flaps 50, 52 so that each folds downward along crease lines that form along the first outer ends 56 of the end flaps 50, 52 (i.e., along the first bend-enhancing portions 86). The operator can also manipulate both side flaps 90, 92 so that each folds downward along crease lines that form along the first outer ends 96 of the side flaps 90, 92 (i.e., along the fourth bend-enhancing portions 120). In this manner, the operator can form a void 12*a* in the receiving portion 11 that define a horizontal void area having a transverse length equivalent to the first distance D1 and a minimum lateral width equivalent to the fourth width W4. The foregoing void 12*a* can be characterized as a "small" void 12*a*, which is sized to snugly fit and retain the small electronic device 4*a* therein.

Figure 5:
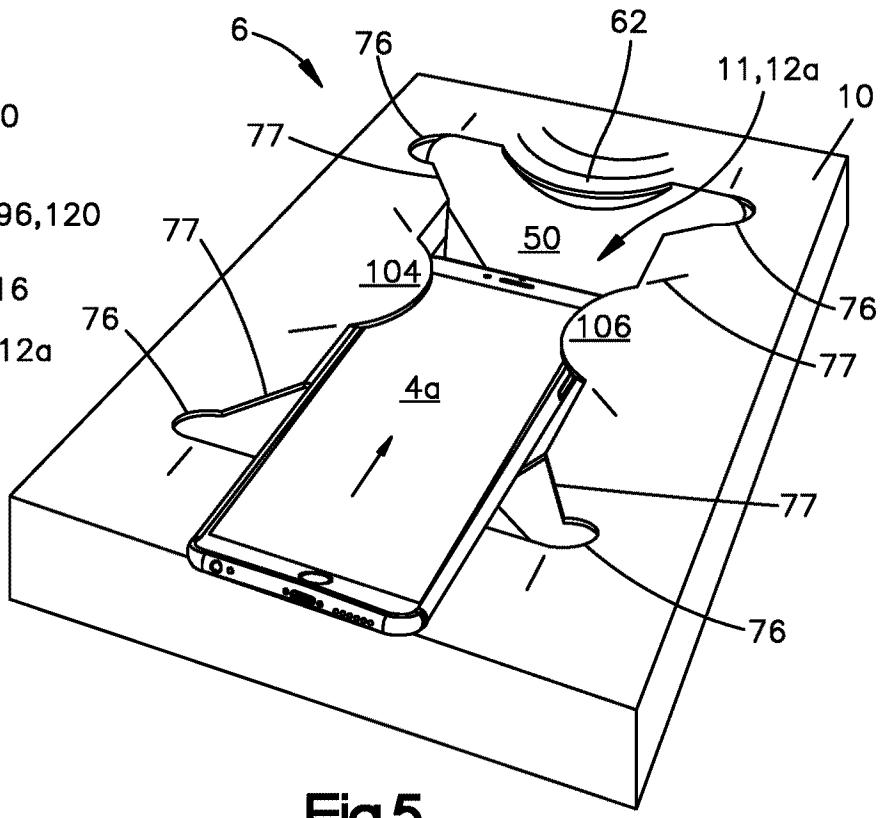
FIG. 5 shows a perspective view of the insert of FIG. 4 receiving a first electronic device therein.
Figure 6:
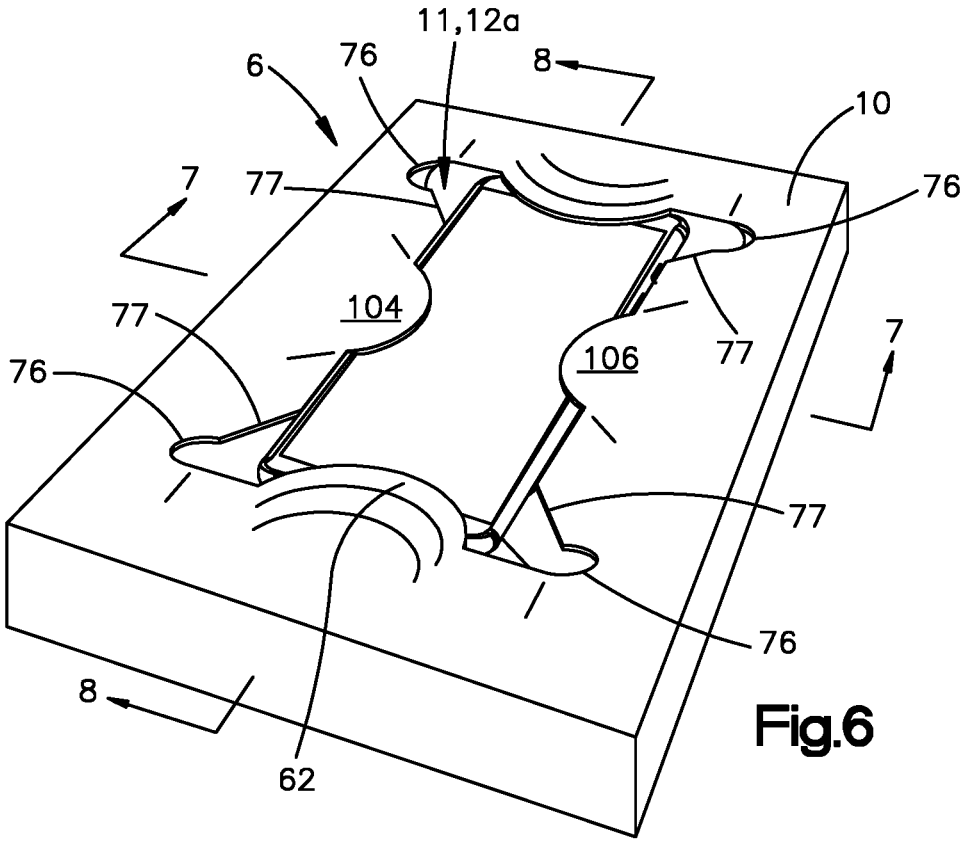
FIG. 6 shows a perspective view of the insert of FIG. 5 with the first electronic device fully received within the insert.

As shown in FIGS. 5 and 6, the operator can optionally insert the small electronic device 4*a* transversely into the small void 12*a* and underneath the side tabs 104, 106 and subsequently underneath the innermost end tab 62 associated with the first end flap 50 as well as underneath the innermost end tab 62 associated with the second end flap 52. In this manner, the display screen of the electronic device 4*a* is immediately presented to the customer upon opening the package 2, which enhances the customer experience. It is to be appreciated that the operator can optionally bend one or more of the innermost end tabs 62 and the side tabs 104, 106 upward as needed to fit the small electronic device 4*a* snugly in the small void 12*a*. As shown, the side protrusions 76 and outer regions of the tapered portion 77 of the end flaps 50, 52 define apertures on the lateral sides of the fully inserted small electronic device 4*a* to facilitate removal of the electronic device 4*a* from the main panel 10, such as by the customer. For this reason, the side protrusions 76 of the end flaps 50, 52 are preferably sized and shaped so that the apertures formed in the space vacated thereby effectively define finger holes in which the customer can insert his or her fingers for easy removal of the electronic device 4*a*.

Referring now to FIG. 7, the side flaps 90, 92 can be sized such that, when the small electronic device 4*a* is inserted within the small void 12*a*, the inner ends 94 of the side flaps 90, 92 can abut the main support surface 42 of the outer box 8, and the side flaps 90, 92 can each extend at a first acute angle α with respect to the main support surface 42 of the outer box 8. In this manner, the side flaps 90, 92 and the side tabs 104, 106 can effectively sandwich the small electronic device 4*a* therebetween so as to inhibit vertical and lateral shifting of the device during storage and/or shipping. As shown, the side flaps 90, 92 can be at least partially molded around the lateral sides of the small electronic device 4*a*, as desired. The insert 6 can be configured such that, in the first operative configuration, the first acute angle α is in in a range of about 30 degrees and about 60 degrees. In other embodiments, the first acute angle α can be in a range of about 10 degrees and about 80 degrees.

Figure 8:
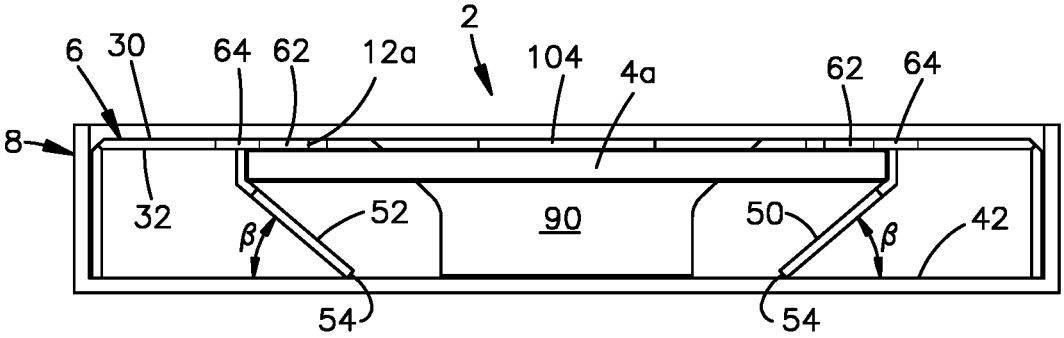
FIG. 8 shows a sectional side view of the insert and the first electronic device, taken along section line 8-8 of FIG. 6.

Referring now to FIG. 8, the end flaps 50, 52 can be sized such that, when the small electronic device 4*a* is inserted within the void 12*a*, the inner ends 54 of the end flaps 50, 52 can abut the main support surface 42 of the outer box 8, and the end flaps 50, 52 can each extend at a second acute angle β with respect to the main support surface of the outer box 8. In this manner, the end flaps 50, 52 and the innermost end tab 62 can also sandwich the small electronic device 4*a* therebetween so as to inhibit vertical and transverse shifting of the device during storage and/or shipping. It is to be appreciated that the operator can optionally bend or mold the end flaps 50, 52 at least partially around the transverse ends of the small electronic device 4*a* as desired. For the small electronic device 4*a*, the insert 6 can be configured such that the second acute angle β is in a range of about 15 degrees and about 45 degrees, or optionally in a range of about 10 degrees and about 80 degrees. In the first operative configuration, the end flaps 50, 52, side flaps 90, 92, innermost end tabs 62, and side tabs 104, 106 of the illustrated embodiment collectively provide twelve (12) points of contact (i.e., one point for each tab and two points for each flap) between the small electronic device 4*a* and the main panel 10.

Figure 9:
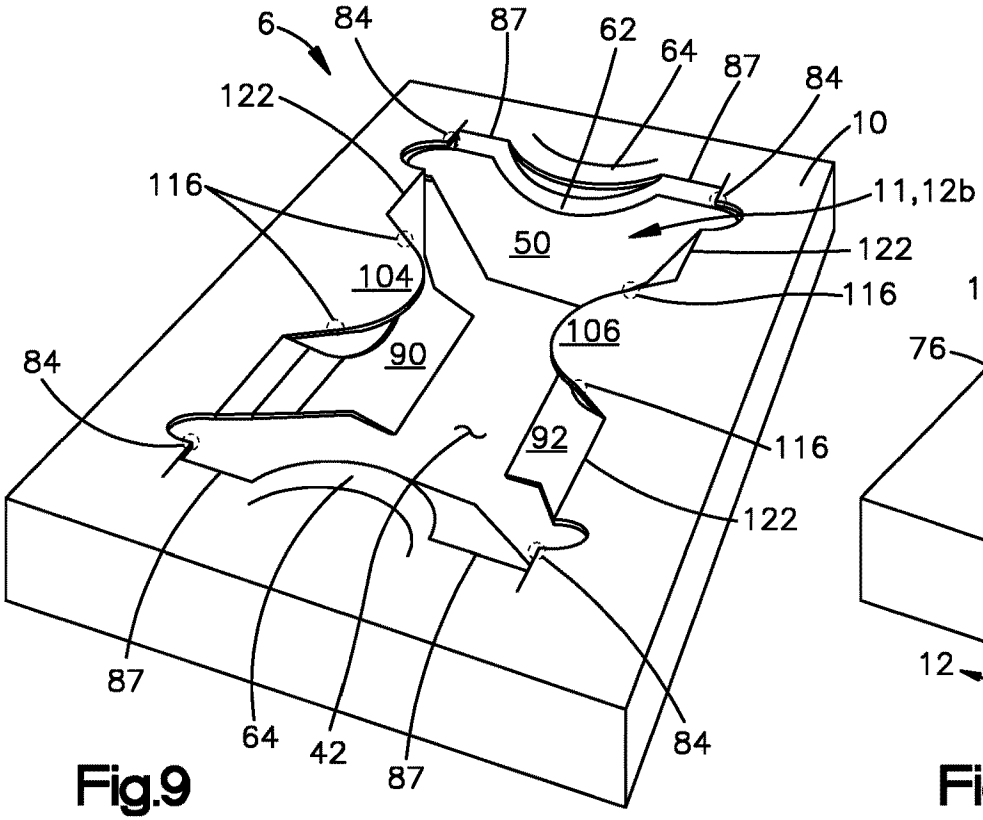
FIG. 9 shows a perspective view of the insert of FIG. 2 in a second operative configuration.

Referring now to FIG. 9, when it is desired to reconfigure the receiving portion 11 into the second operative configuration (for receiving the medium electronic device 4*b* therein), the operator can fracture the end nicks 84 and manipulate the end flaps 50, 52 so as to form crease lines along the second bend-enhancing portions 87 (on either lateral side of the respective intermediate tab 64). The operator can fold the end flaps 50, 52 downward along these crease lines. The operator can also fracture the side nicks 116 as needed and manipulate both side flaps 90, 92 so that each folds downward along a crease line that forms along the fifth bend-enhancing portion 122 (on either transverse side of the side tab 104, 106). In this manner, the end flaps 50, 52 can effectively be extended transversely outward along the to the second bend-enhancing portions 87 thereof, and the side flaps 90, 92 can effectively be extended laterally outward to the fifth bend-enhancing portions 122 thereof. Thus, the operator can form a void 12*b* so that its horizontal void area has a transverse length equivalent to the second distance D2 and a minimum lateral width equivalent to the fifth width W5. The foregoing void 12*b* can be characterized as a "medium" void 12*b*, which is sized to snugly fit and retain the medium electronic device 4*b* therein.

Figure 10:
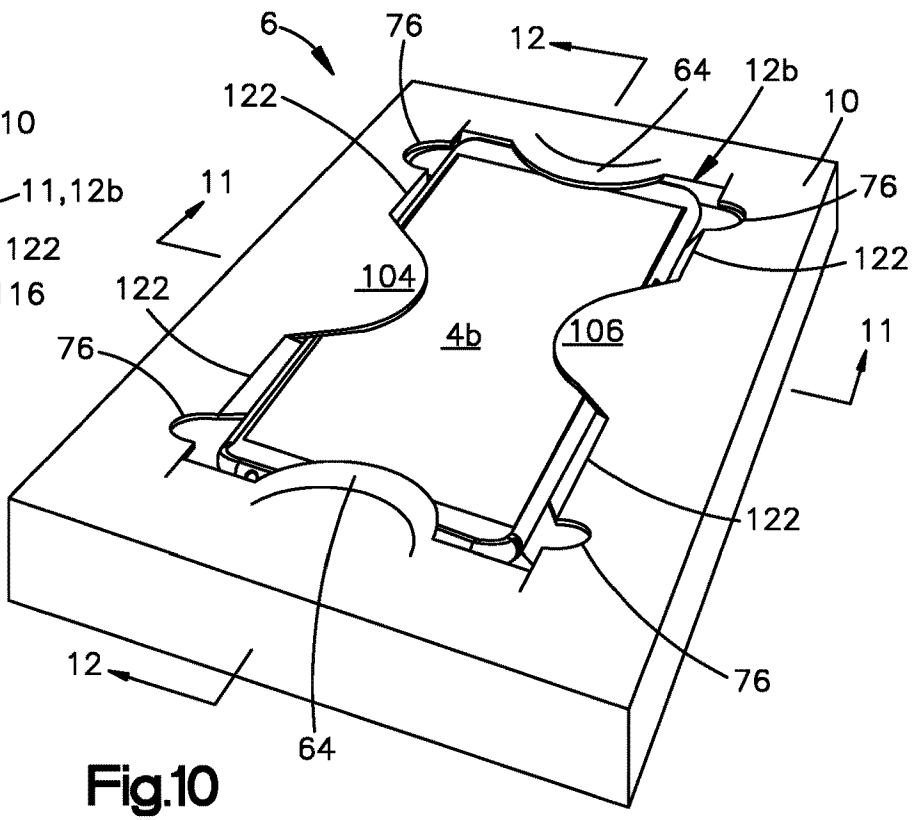
FIG. 10 shows a perspective view of the insert of FIG. 9 with a second electronic device fully received within the insert, wherein the second electronic device is larger than the first electronic device shown in FIG. 6.

Referring now to FIG. 10, the medium electronic device 4*b* can be inserted transversely into the medium void 12*b* and underneath the side tabs 104, 106 in a manner similar to that set forth above with reference to FIG. 5. Subsequently, the medium electronic device 4*b* can be inserted underneath the intermediate end tabs 64. As before, the operator can optionally bend one or more of the intermediate end tabs 64 and the side tabs 104, 106 upward as needed to fit the medium electronic device 4*b* snugly in the medium void 12*b*. The side protrusions 76 define apertures (such as to form finger holes) on the lateral sides of the fully inserted medium electronic device 4*b* to facilitate removal of the electronic device 4*b* from the main panel 10, as set forth above.

Figure 11:
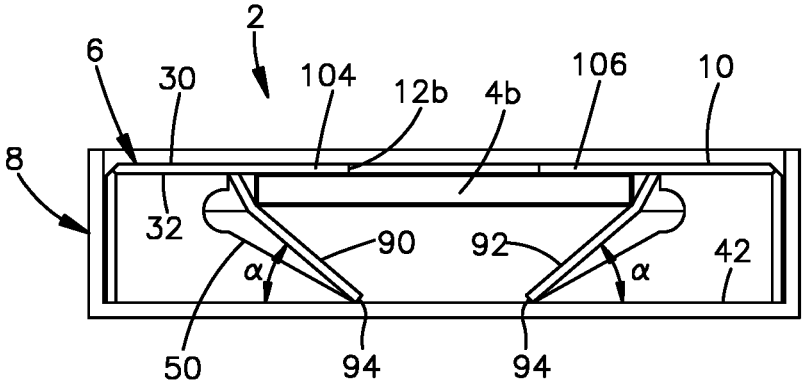
FIG. 11 shows a sectional end view of the insert and the second electronic device, taken along section line 11-11 of FIG. 10.
Figure 12:
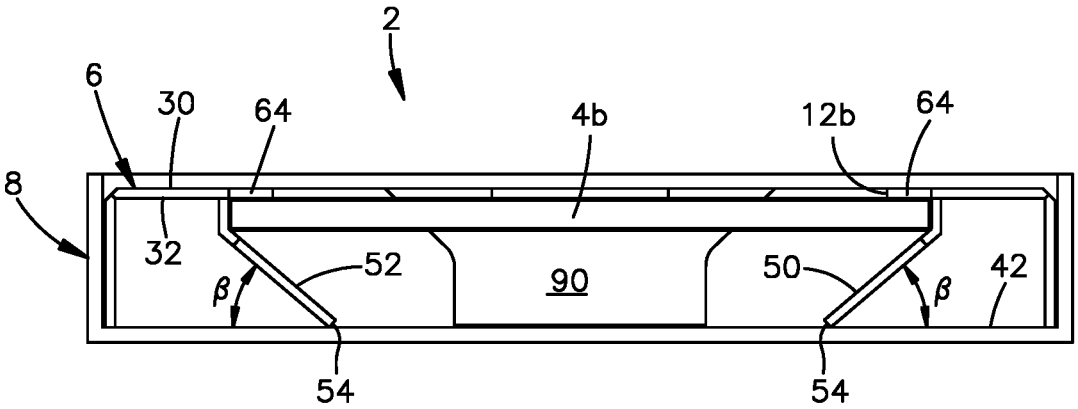
FIG. 12 shows a sectional side view of the insert and the second electronic device, taken along section line 12-12 of FIG. 10.

Referring now to FIGS. 11 and 12, the side flaps 90, 92 and end flaps 50, 52 can each be sized such that, in the second operative configuration, the inner ends 94 of the side flaps 90, 92 and the inner ends 56 of the end flaps 50, 52 can each abut the main support surface of the outer box 8 so that: the first acute angle α of the side flaps 90, 92 is in in a range of about 15 degrees and about 45 degrees, or optionally in a range of about 10 degrees and about 80 degrees; and the second acute angle β of the end flaps 50, 52 is in a range of about 15 degrees and about 45 degrees, or optionally in a range of about 10 degrees and about 80 degrees. As before, the side flaps 90, 92 and side tabs 104, 106 and the end flaps 50, 52 and end tabs 62, 64, 66 can effectively sandwich the medium electronic device 4*b* therebetween so as to inhibit vertical, lateral, and transverse shifting of the device during storage and/or shipping, and the operator can optionally bend or mold the side flaps 90, 92 and end flaps 50, 52 at least partially around the lateral sides and transverse ends, respectively, of the device as desired. When the receiving portion 11 is in the second operative configuration, the end flaps 50, 52, side flaps 90, 92, intermediate end tabs 64, and side tabs 104, 106 continue to provide twelve (12) points of contact between medium electronic device 4*b* and the main panel 10.

Figure 13:
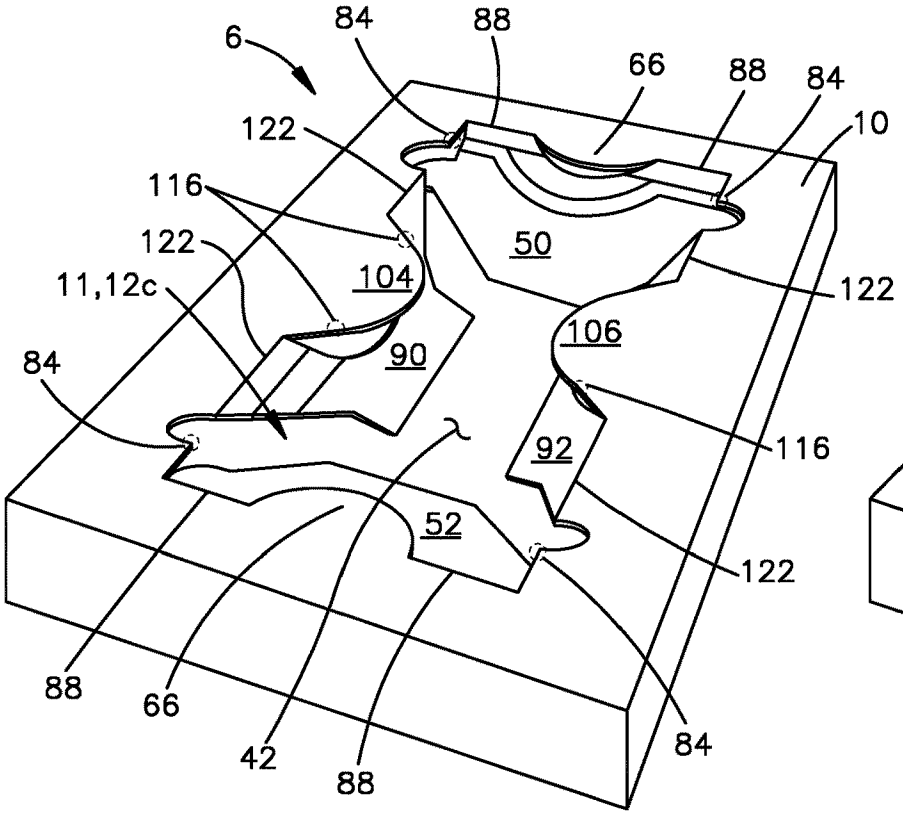
FIG. 13 shows a perspective view of the insert of FIG. 2 in a third operative configuration.

Referring now to FIG. 13, when it is desired to reconfigure the receiving portion 11 from the initial configuration into the third operative configuration (for receiving the large electronic device 4*c* therein), the operator can fracture the end nicks 84 and the side nicks 116. In this manner, the operator can manipulate both end flaps 50, 52 so that each folds downward along crease lines that form along the third bend-enhancing portion 88 (on either lateral side of the outer tab 66). The operator can also manipulate both side flaps 90, 92 so that each folds downward along a crease line that forms along the fifth bend-enhancing portion 122 (on either transverse side of the side tab 104, 106). In this manner, the end flaps 50, 52 can effectively be extended transversely outward to their second outer ends, and the side flaps 90, 92 can effectively be extended laterally outward to their second outer ends. Thus, the operator can form a void 12*c* so that its horizontal void area has a transverse length equivalent to the third distance D2 and a minimum lateral width equivalent to the fifth width W5. The foregoing void 12*c* can be characterized as a "large" void 12*c*, which is sized to snugly fit and retain the large electronic device 4*c* therein.

Figure 14:
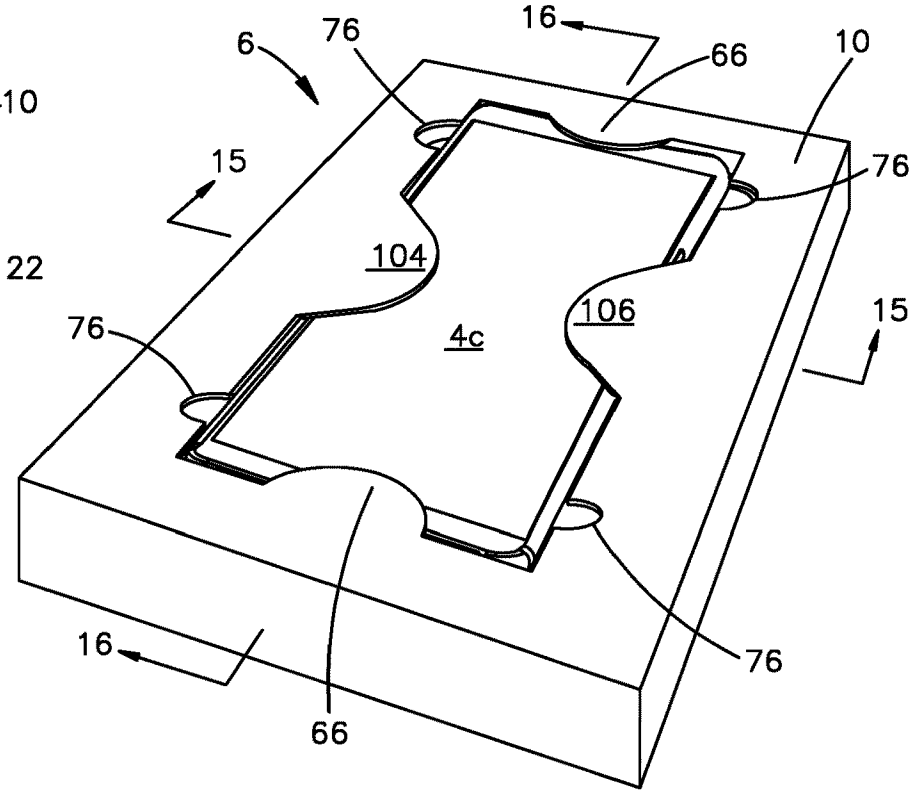
FIG. 14 shows a perspective view of the insert of FIG. 13 with a third electronic device fully received within the insert, wherein the third electronic device is larger than the second electronic device shown in FIG. 10.

Referring now to FIG. 14, the large electronic device 4*c* can be inserted transversely into the large void 12*c* and underneath the side tabs 104, 106 in a manner similar to that set forth above with reference to FIG. 5. Subsequently, the large electronic device 4*c* can be inserted underneath the outermost end tabs 66. As before, the operator can optionally bend one or more of the outermost end tabs 66 and the side tabs 104, 106 upward as needed to fit the large electronic device 4*c* snugly in the void 12*c*. In the third operative configuration, the side protrusions 76 by themselves can define the apertures (such as to form finger holes) on the lateral sides of the fully inserted large electronic device 4*c*. Without these apertures, removal of the large electronic device 4*c* from the main panel 10 can be cumbersome, which can significantly diminish the customer experience.

Figure 15:
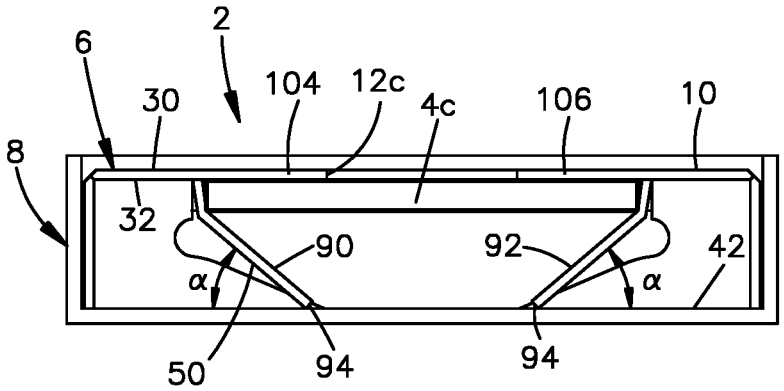
FIG. 15 shows a sectional end view of the insert and the third electronic device, taken along section line 15-15 of FIG. 14.
Figure 16:
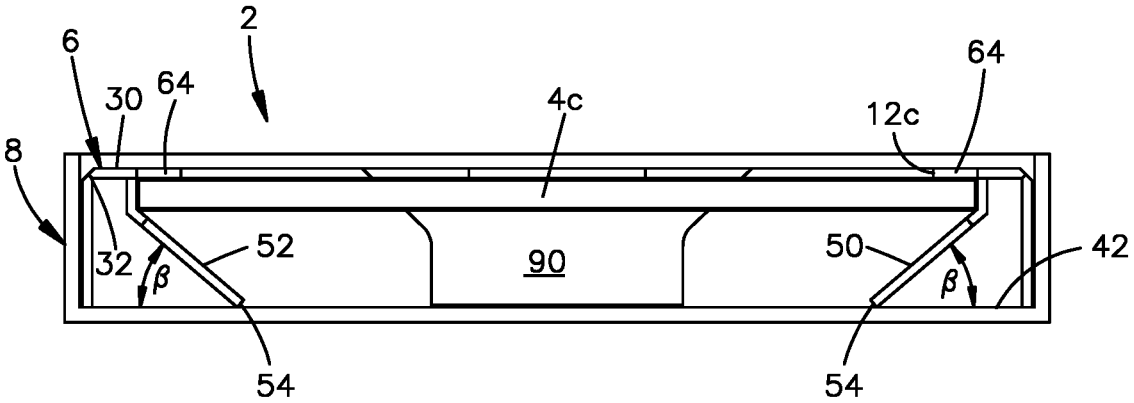
FIG. 16 shows a sectional side view of the insert and the third electronic device, taken along section line 16-16 of FIG. 14.

Referring now to FIGS. 15 and 16, the side flaps 90, 92 and end flaps 50, 52 can each be sized such that, in the third operative configuration, the inner ends 94 of the side flaps 90, 92 and the inner ends 56 of the end flaps 50, 52 can each abut the main support surface 42 of the outer box 8 so that: the first acute angle α of the side flaps 90, 92 is in in a range of about 15 degrees and about 45 degrees, or optionally in a range of about 10 degrees and about 80 degrees; and the second acute angle β of the end flaps 50, 52 is in in a range of about 5 degrees and about 35 degrees, or optionally in a range of about 5 degrees and about 80 degrees. As before, the side flaps 90, 92 and side tabs 104, 106 and the end flaps 50, 52 and end tabs can effectively sandwich the large electronic device 4*c* therebetween so as to inhibit vertical, lateral, and transverse shifting of the device during storage and/or shipping, and the operator can optionally bend or mold the side and end flaps 50, 52 at least partially around the lateral sides and transverse ends, respectively, of the device as desired. When the receiving portion 11 is in the third operative configuration, the end flaps 50, 52, side flaps 90, 92, outermost end tabs 66, and side tabs 104, 106 continue to provide twelve (12) points of contact between the large electronic device 4*c* and the main panel 10.

The inventors have performed numerous tests on the shock and vibrational absorbency of the insert 6 in various operative configurations while carrying electronic devices 4. Through these tests, the inventors have discovered that the insert 6 configured as set forth herein performs superior so other inserts, including prior art inserts, with respect to shock and vibrational absorbency.

It is to be appreciated that the receiving portion 11 as described above provides size modularity that can also provide a snug fit for electronic devices 4 that are sized intermediate of the small and medium devices 4*a,b* as well as electronic devices that are sized intermediate of the medium and large devices 4*b,c*. With regards to electronic devices that are sized intermediate of the small and medium devices 4*a,b*, the operator can form an appropriately sized void 12 by depressing one of the end flaps 50, 52 and one of the side flaps 90, 92 in the manner set forth above with reference to forming the small void 12*a*, while depressing the other end flap and side flap 90, 92 in the manner set forth above with reference to forming the medium void 12*b*. With regards to electronic devices that are sized intermediate of the medium- and large-sized devices 4*b,c*, the operator can form an appropriately sized void 12 by depressing one of the end flaps 50, 52 and one of the side flaps 90, 92 in the manner set forth above with reference to forming the medium void 12*b*, while depressing the other end flap and side flap 90, 92 in the manner set forth above with reference to forming the large void 12*c*.

It is to be appreciated that, while the illustrated embodiments show each side flap 90, 92 as having only one side tab 104, 106 associated therewith, in other embodiments, each side flap 90, 92 can have a nested series of side tabs 104, 106 in a manner similar to the first and second series of end tabs.

Referring again to FIG. 2, the second endwall panel 40 can include a pair of slots 124 cut through the panel 40. The slots 124 can be sized to receive prongs of an electrical plug. In this manner, an electrical plug accessory 18 (such as for a charger or adapter) can be inserted and retained within the slots 124 during storage and shipping. The accessory panel 16 can also include a plurality of pre-defined fold lines 126, such as score lines, in a manner defining at least three (3) folding segments 128 of the accessory panel 16. A laterally outermost one 128a of the folding segments 128 can define a cutout 130 sized to allow the customer to insert their finger therein. As can be seen in FIG. 1, the outermost folding segment 128*a* can be folded upright while the other folding segments 128 remain flat. In such a configuration, accessories 18 can be placed directly on the accessory panel 16 or within an accessory box that is placed on the accessory panel 16.

Figure 17:
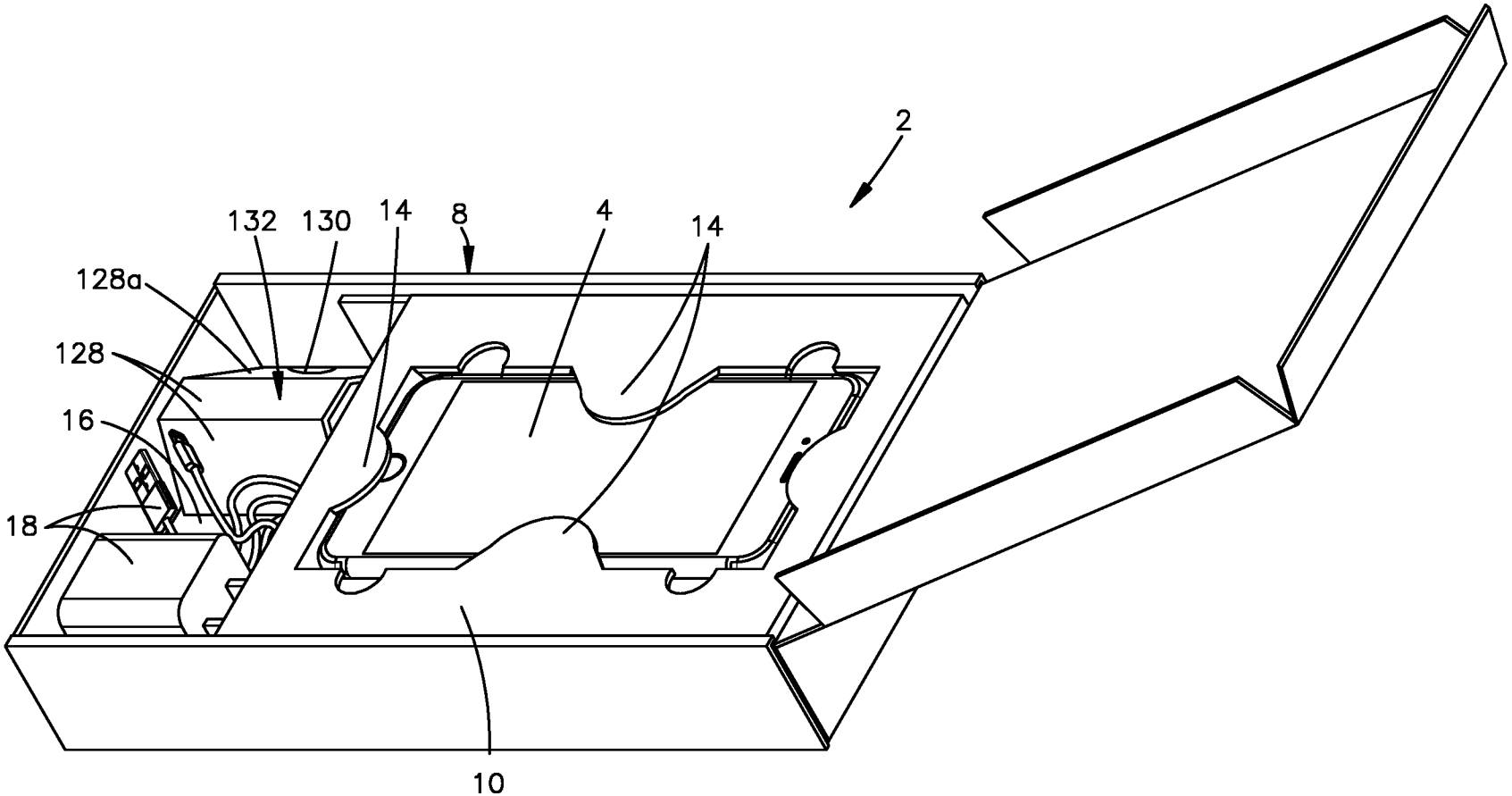
FIG. 17 is a perspective view of an accessory portion of the package assembly of FIG. 1.

Referring now to FIG. 17, the folding segments 128 can be folded so as to form a trapezoidal cover 132 so that accessories 18 can be stored underneath. Additional accessories 18 can stored in the space laterally adjacent the trapezoidal cover 132. The cutout 130 can be configured to allow the customer to insert a finger therein and unfold the trapezoidal cover to access the accessories 18 stored underneath.

Figure 18:
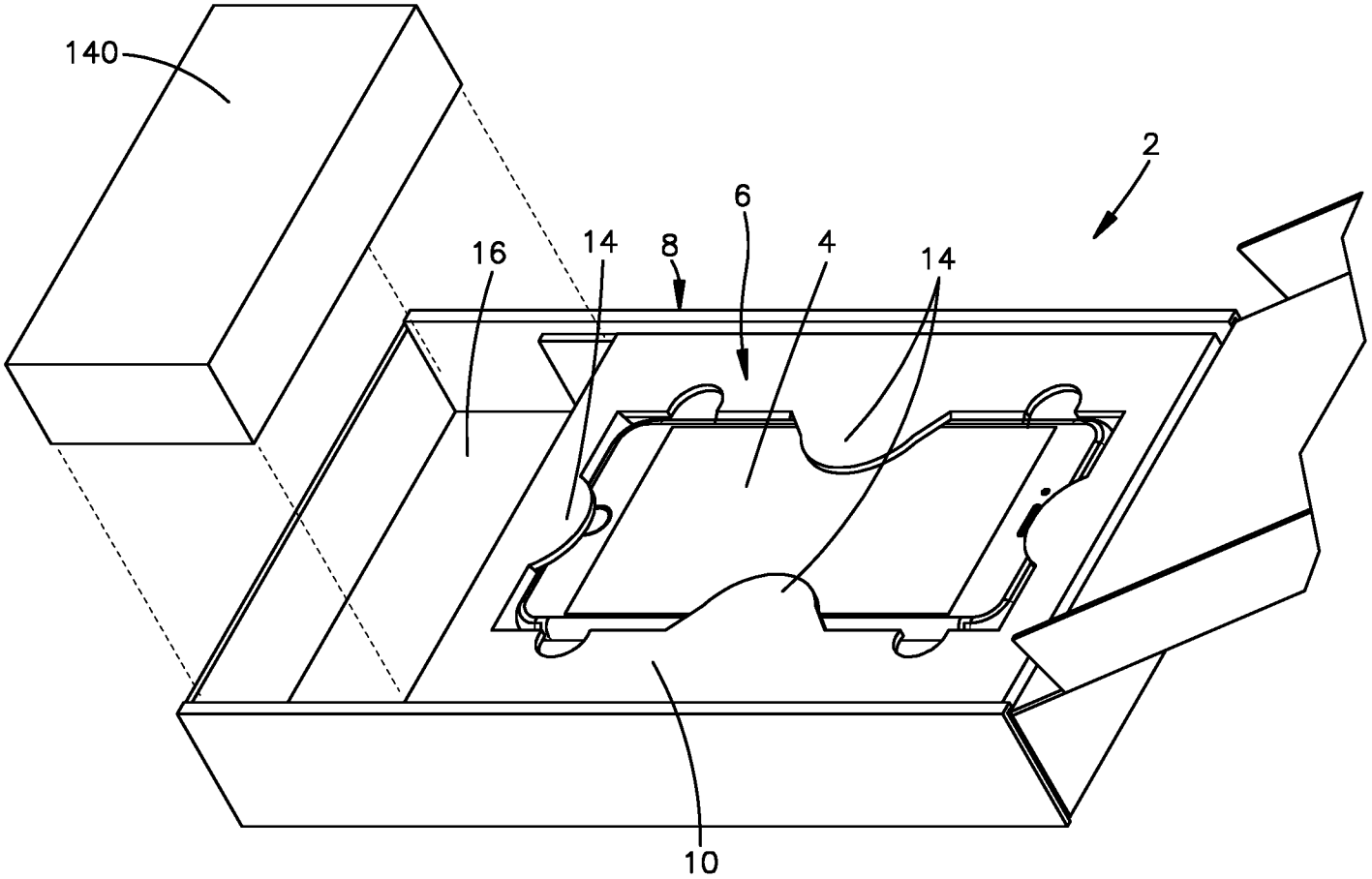
FIG. 18 is a perspective view of the package assembly adapted to receive an accessory box carrying accessories, according to an embodiment of the present disclosure.

In other embodiments, as shown in FIG. 18, the accessory panel 16 can be devoid of folding segments. In such embodiments, the accessories can be placed in an accessory box 140, which can be placed on the accessory panel 16 (and in the accessory space of the outer box 8 provided by the accessory panel 16).

According to the embodiments disclosed herein, an example method of packaging an item includes obtaining a packaging insert 6 that includes a main panel 10 defining a periphery 28 and a plurality of flaps 50, 52, 90, 92 extending inwardly. The present example method includes folding the plurality of flaps 50, 52, 90, 92 so that the insert 6 defines a void 12 sized to receive the item, and selectively folding a first flap 50 of the plurality of flaps about at least one of 1) a first outer end 56 of the first flap 50 so as to provide the void 12, and 2) a second outer end 88 of the first flap so as to increase a size of the void 12, wherein selectively folding the first flap 50 about the second outer end 88 comprises breaking at least one frangible portion 84 of the main panel 10 positioned between the first and second outer ends 56, 88. In the present example method, the at least one frangible portion 84 can include a pair of frangible portions 84 located on opposite sides 75 of the first flap 50, and the breaking step comprises breaking the pair of frangible portions 84.

The present example method can include selectively folding a second flap 50 of the plurality of flaps about at least one of 1) a first outer end 56 of the second flap 50 so as to provide the void 12, and 2) a second outer end 88 of the second flap 52 so as to further increase the size of the void 12, wherein the second flap 52 is positioned opposite the first flap 50. The step of selectively folding the second flap 52 about its second outer end 88 comprises breaking at least one second frangible portion 84 of the main panel 10 positioned between the first and second outer ends 56, 88 of the second flap 52. The present example method can include selectively folding a third flap 90 of the plurality of flaps about at least one of 1) a first outer end 96 of the third flap 90 so as to provide the void 12, and 2) a second outer end 122 of the third flap 90 so as to further increase the size of the void 12, wherein the third flap 90 is positioned between the first and second flaps 50, 52 with respect to a first direction T. The step of selectively folding the third flap 92 about the second outer end 122 comprises breaking at least one third frangible 116 portion of the main panel 10 positioned between the first and second outer ends 96, 122 of the third flap 90. The present example method can include selectively folding a fourth flap 92 of the plurality of flaps about at least one of 1) a first outer end 96 of the fourth flap 90 so as to provide the void 12, and 2) a second outer end 122 of the fourth flap 92 so as to further increase the size of the void 12, wherein the fourth flap 92 is positioned opposite the third flap 90 along a second direction L that is offset from the first direction T. The step of selectively folding the fourth flap 92 about its second outer end 122 comprises breaking at least one fourth frangible portion 116 of the main panel 10 positioned between the first and second outer ends 96, 122 of the fourth flap 92. The present example method can include placing the item in the void 12, and can also include placing the insert 6 within an outer box 8, which can be done before or after placing the item in the void 12.

According to the embodiments disclosed herein, an example method of preparing a packaging insert 6 to receive an item to be packaged includes: identifying a maximum dimension of the item; and folding a plurality of flaps 50, 52, 90, 92 defined by the packaging insert 6 so that the plurality of flaps 50, 52, 90, 92 collectively define a void 12. In the present example method, the folding step includes selectively folding a first flap 50 of the plurality of flaps about at least one of: (1) a first bend-enhancing portion 86 at least partially defined by an inner tab 62 located at an outer end 56 of the first flap so as to cause the void 12 to define a first distance along a first direction T; (2) a second bend-enhancing portion 88 at least partially defined by an outer tab 66 located at a second outer end of the first flap 50 so as to cause the void 12 to define a second distance along the first direction T; and (3) a third bend-enhancing portion 87 at least partially defined by a middle tab 64 located between the inner tab 62 and the outer tab 66 so as to cause the void 12 to define a third distance along a first direction T, wherein at least one of the first, second, and third distances is greater than the maximum dimension of the item.

In the present example method, the step of selectively folding the first flap 50 about the first bend-enhancing portion 86 can cause the inner tab 62 to extend over the void 12. In the present example method, the step of selectively folding the first flap 50 about the third bend-enhancing portion 87 comprises folding the inner tab 62 together with the first flap 50 about the third bend-enhancing portion 87 and causing the middle tab 64 to extend over the void 12. In the present example method, the step of selectively folding the first flap 50 about the second bend-enhancing portion 88 comprises folding the inner and middle tabs 62, 64 together with the first flap 50 about the second bend-enhancing portion 88 and causing the outer tab 66 to extend over the void 12. In the present example method, each of the inner, middle, and outer tabs 62, 64, 66: (1) is positioned between opposed sides 75 of the first flap 50 with respect to a second direction L that is perpendicular to the first direction T, and 2) defines an inner edge 68 having outer termini 72. In the present example method, the inner tab 62 can define a first width W1 measured between the outer termini 72 thereof along the second direction L, the middle tab 64 can defines a second width W2 measured between the outer termini 72 thereof along the second direction L, and the outer tab 66 can define a third width W3 measured between the outer termini 72 thereof along the second direction L, such that the first width W1 is greater than the second width W2, and the second width W2 is greater than the third width W3. In the present example method, the first bend-enhancing portion 86 can extend outwardly along the second direction L from the outer termini 72 of the inner tab 62 to the opposed sides 75 of the first flap 50; the second bend-enhancing portion 88 can extend outwardly along the second direction L from the outer termini 72 of the outer tab 66 to the opposed sides 75 of the first flap 50; and the third bend-enhancing portion 87 can extend outwardly along the second direction L from the outer termini 72 of the middle tab 64 to the opposed sides 75 of the first flap 50. In the present example method, selectively folding the first flap 50 about either the second or third bend-enhancing portion 88, 87 comprises breaking a pair of frangible portions 84 of the packaging insert 6 positioned between the first and third bend-enhancing portions 86, 87 with respect to the first direction T.

According to the embodiments disclosed herein, another example method of packaging an item includes: obtaining an insert 6 having a main panel 10; folding at least a pair of sidewall panels 34, 36 of the insert 6 downward from the main panel 10; inserting the insert 6 within an outer box 8 so that the main panel 10 is elevated above a support surface 42 of the outer box 8 via the pair of sidewall panels 34, 36 by a distance; and folding a plurality of flaps 50, 52, 90, 92 defined by the main panel 10 so as to form a void 12 in the insert 6. In the present example method, the folding step includes: selectively folding each of a pair of side flaps 90, 92 of the plurality of flaps downward about at least one of 1) a first outer end 96 of the respective side flap 90, 92 so as to form the void 12, and 2) a second outer end 122 of the respective side flap 90, 92 so as to increase a size of the void 12; and the method includes causing inner ends 94 of the pair of side flaps 90, 92 to contact the support surface 42 of the outer box 8; and placing the item in the void 12 so that the item is supported by the pair of side flaps 90, 92. In the present example method, the placing step can include bending one or both of the pair of side flaps around the item. In the present example method, the step of selectively folding each of the pair of side flaps 90, 92 downward about the respective second outer end 122 can include breaking at least one frangible portion 116 of the main panel 10 positioned between the first and second outer ends 96, 122 of each of the pair of side flaps 90, 92, respectively. In the present example method, the step of causing the inner ends 94 of the pair of side flaps 90, 92 to contact the support surface 42 of the outer box 8 can include causing the pair of side flaps 90, 92 to each be oriented at an acute angle $\alpha$ in a range of about 15 and about 60 degrees with respect to the support surface 42 of the outer box 8. In the present example method, the second folding step can occur before the inserting step.

Additional non-limiting example embodiments of the present disclosure are set forth below.

Embodiment 1: An insert for packaging an electronic device, the insert including a panel, the panel comprising: first and second flaps extending inwardly toward each other along a first direction; third and fourth flaps extending inwardly toward each other along a second direction that is offset from the first direction, each of the first, second, third, and fourth flaps defining an inner end and an outer end, wherein: the first, second, third, and fourth flaps are each foldable about the outer end thereof so as to collectively define a void defining a first total area; the outer ends of the first and second flaps are respective first outer ends; each of the first and second flaps defines a second outer end outward of the first outer end; and the first and second flaps are selectively foldable about the second outer end thereof to as to increase the area of the void to a second total area; a first inner tab extending inwardly from the first outer end of the first flap; a second inner tab extending inwardly from the first outer end of the second flap, wherein each of the first and second inner tabs is configured to 1) extend over the void defining the first total area, and 2) fold with the respective first or second flap about the second outer end thereof; a first outer tab extending inwardly from the second outer end of the first flap; a second outer tab extending inwardly from the second outer end of the second flap, wherein each of the first and second outer tabs is configured to extend over the void defining the second total area, wherein the second total area is sized to receive an electronic device larger than an electronic device receivable within the first total area Embodiment 2: The insert of Embodiment 1, wherein the panel defines: a first intermediate tab nested between the first inner tab and the first outer tab, wherein the first inner tab, the first intermediate tab, and the first outer tab define a first series of tabs of the first flap; and a second intermediate tab nested between the second inner tab and the second outer tab, wherein the second inner tab, the second intermediate tab, and the second outer tab define a second series of tabs of the second flap.

Embodiment 3: The insert of Embodiment 2, wherein each tab of the first and second series of tabs defines an inner edge that is arcuate and inwardly convex and defines outer termini, such that, in each of the first and second series of tabs: the inner tab defines a first width measured between the outer termini of the inner tab along the second direction; the intermediate tab defines a second width measured between the outer termini of the intermediate tab along the second direction; and the outer tab defines a third width measured between the outer termini of the outer tab along the second direction, wherein the first width is greater than the second width, and the second width is greater than the third width.

Embodiment 4: The insert of Embodiment 3, wherein: each of the first and second flaps defines: opposed lateral sides extending from the second outer end to the inner end; a first bend-enhancing portion extending from the outer termini of the inner tab to the opposed lateral sides along the second direction, wherein the first bend-enhancing portion defines the first outer end; a second bend-enhancing portion extending from the outer termini of the intermediate tab to the opposed lateral sides; and a third bend-enhancing portion extending from the outer termini of the outer tab to the opposed lateral sides, wherein the third bend-enhancing portion defines the second outer end; and each of the first and second flaps is selectively foldable along the first, second, and third bend-enhancing portions so as to adjust the area of the void so as to separately fit electronic devices of varying sizes within the void.

Embodiment 5: An insert for a package, comprising: a panel defining: a periphery and a location inward of the periphery; a plurality of flaps each defining an outer end and an inner end such that each flap extends inwardly from its outer end to its inner end, wherein each flap of the plurality of flaps is foldable about its outer end so that the plurality of flaps collectively define a void, wherein a first flap of the plurality of flaps has a second outer end spaced outwardly from the outer end of the first flap, the panel defines at least one frangible portion between the outer end and the second outer end of the first flap, the first flap is selectively foldable about 1) its outer end so as to at least partially define the void, and 2) its second outer end, after breaking the at least one frangible portion, so as to increase a size of the void.

Embodiment 6: The insert of Embodiment 5, wherein a second flap of the plurality of flaps is positioned opposite the first flap.

Embodiment 7: The insert of Embodiment 6, wherein the second flap defines a second outer end spaced outwardly from the outer end of the second flap, the panel defines at least one second frangible portion between the outer end and the second outer end of the second flap, the second flap is selectively foldable about 1) its outer end so as to a least partially define the void, and 2) its second outer end, after breaking the at least one second frangible portion, so as to increase the size of the void.

Embodiment 8: The insert of Embodiment 7, wherein the plurality of flaps includes a third flap and a fourth flap opposite one another, and the third and fourth flaps each extend between the inner ends of the first and second flaps.

Embodiment 9: The insert of Embodiment 8, wherein each of the third and fourth flaps defines a second outer end spaced outwardly from the outer end, and the panel defines: at least one third frangible portion between the outer end and the second outer end of the third flap; and at least one fourth frangible portion between the outer end and the second outer end of the fourth flap, wherein each of the third and fourth flaps is selectively foldable about 1) its outer end so as to at least partially define the void, and 2) its second outer end, after breaking the respective at least one third or fourth frangible portion, so as to increase the size of the void.

Embodiment 10: The insert of Embodiment 8 or Embodiment 9, wherein the first and second flaps are opposite each other along a first direction, and the third and fourth flaps are opposite each other along a second direction substantially perpendicular to the first direction.

Embodiment 11: The insert of any one of Embodiments 8 through 9, wherein the panel further defines a first side tab extending inward from the outer end of the third flap and a second side tab extending inward from the outer end of the fourth flap, wherein the first and second side flaps are each configured to extend over the void when the third and fourth flaps are folded about their outer ends.

Embodiment 12: The insert of Embodiment 11, wherein the first and second side tabs each define outer termini at the respective outer ends of the third and fourth flaps, and the panel further defines: a first pair of extension features extending inwardly from the second outer end of the third flap toward the outer termini of the first side tab so as to define a pair of third frangible portions of the panel between the outer termini of the first side tab and the pair of third extension features; and a second pair of extension features extending inwardly from the second outer end of the fourth flap toward the outer termini of the second side tab so as to define a pair of fourth frangible portions of the panel between the outer termini of the second side tab and the second pair of extension features.

Embodiment 13: The insert of any one of Embodiments 8 through 12, wherein the insert further comprises first and second sidewall panels extending outwardly from opposite sides of the panel along a direction, each sidewall panel configured to be folded downward substantially orthogonally from the panel such that the panel can be supported over a main support surface of an outer box by the first and second sidewall panels.

Embodiment 14: The insert of Embodiment 13, wherein each of the third and fourth flaps is configured to be folded downward about its outer end such that its inner end contacts the main support surface of the outer box.

Embodiment 15: The insert of Embodiment 14, wherein each of the third and fourth flaps is configured so as to define an acute angle with respect to the main support surface when its inner end contacts the main support surface, and the acute angle is in a range of about 20 degrees and about 55 degrees.

Embodiment 16: The insert of Embodiment 15, wherein the acute angle is in a range of about 40 degrees and about 50 degrees.

Embodiment 17: The insert of any one of Embodiments 5 through 16, wherein the first flap defines a bend-enhancing portion located between the outer end and the second outer end of the first flap, and the first flap is selectively foldable about the bend-enhancing portion so as to adjust the size of the void.

Embodiment 18: The insert of any one of Embodiments 5 through 17, wherein the second flap defines a bend-enhancing portion located between the outer end and the second outer end of the second flap, and the second flap is selectively foldable about its bend-enhancing portion so as to adjust the size of the void.

Embodiment 19: The insert of any one of Embodiments 5 through 18, wherein the panel further defines: an inner tab extending inward from the outer end of the first flap, wherein the inner tab is configured 1) to extend over the void when the first flap is folded about its outer end, and 2) to fold with the first flap when the first flap is folded about its second outer end; and an outer tab extending inward from the second outer end of the first flap, wherein the outer tab is configured to extend over the void when the first flap is folded about its second outer end.

Embodiment 20: The insert of any one of Embodiments 7 through 19, wherein the panel further defines: a second inner tab extending inward from the outer end of the second flap, wherein the second inner tab is configured 1) to extend over the void when the second flap is folded about its outer end, and 2) to fold with the second flap when the second flap is folded about its second outer end; and a second outer tab extending inward from the second outer end of the second flap, wherein the second outer tab is configured to extend over the void when the second flap is folded about its second outer end.

It should be noted that the illustrations and descriptions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should further be appreciated that the various alternative embodiments described above with respect to one illustrated embodiment can apply to all embodiments as described herein, unless otherwise indicated.

Unless explicitly stated otherwise, each numerical value and range should be interpreted as being approximate as if the word "about" or "approximately" preceded the value or range.

It should be understood that the steps of exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

What is claimed is:

1. A method of packaging an item, the method comprising:

obtaining a packaging insert that includes a main panel defining a periphery and a plurality of flaps, wherein the main panel is in a flat, die-cut configuration, in which the plurality of flaps extend inwardly away from the periphery and toward a central region of the main panel; and folding the plurality of flaps so that the insert defines a void in the central region, the void sized to receive the item, wherein folding the plurality of flaps includes selectively folding a first flap of the plurality of flaps about at least one of 1) a first bend-enhancing portion of the first flap so as to expose the void, wherein the first bend-enhancing portion is spaced from an inner end of the first flap along a first direction, and 2) a second bend-enhancing portion of the first flap so as to increase a size of the void, wherein the first bend-enhancing portion is located intermediate the inner end and the second bend-enhancing portion with respect to the first direction, and the first and second bend-enhancing portions are located intermediate the inner end and a respective portion of the periphery along the first direction, and wherein selectively folding the first flap about the second bend-enhancing portion is performed after breaking at least one frangible portion of the main panel, the at least one frangible portion is spaced from each of the first and second bend-enhancing portions and is positioned between the first and second bend-enhancing portions, and the inner end of the first flap remains attached to the main panel after breaking the at least one frangible portion.

2. The method of claim 1, wherein the at least one frangible portions comprises a pair of frangible portions located on opposite sides of the first flap, and the breaking step comprises breaking the pair of frangible portions.

3. The method of claim 1, further comprising selectively folding a second flap of the plurality of flaps about at least one of 1) a first bend-enhancing portion of the second flap so as to expose the void, wherein the first bend-enhancing portion of the second flap is spaced from an inner end of the second flap along the first direction and 2) a second bend-enhancing portion of the second flap so as to further increase the size of the void, wherein the first bend-enhancing portion of the second flap is located intermediate the inner end of the second flap and the second bend-enhancing portion of the second flap with respect to the first direction, wherein the second flap is positioned opposite the first flap along the first direction, and selectively folding the second flap about the second bend-enhancing portion thereof is performed after breaking at least one second frangible portion of the main panel positioned between the first and second bend-enhancing portions of the second flap.

4. The method of claim 3, further comprising selectively folding a third flap of the plurality of flaps about at least one of 1) a first bend-enhancing portion of the third flap so as to expose the void, and 2) a second bend-enhancing portion of the third flap so as to further increase the size of the void, wherein the third flap is positioned between the first and second flaps with respect to the first direction, and selectively folding the third flap about the second bend-enhancing portion is performed after breaking at least one third frangible portion of the main panel positioned between the first and second bend-enhancing portions of the third flap.

5. The method of claim 4, further comprising selectively folding a fourth flap of the plurality off laps about at least one of 1) a first bend-enhancing portion of the fourth flap so as to expose the void, and 2) a second bend-enhancing portion of the fourth flap so as to further increase the size of the void, wherein the fourth flap is positioned opposite the third flap along a second direction that is offset from the first direction, and selectively folding the fourth flap about the second bend-enhancing portion is performed after breaking at least one fourth frangible portion of the main panel positioned between the first and second bend-enhancing portions of the fourth flap.

6. The method of claim 1, further comprising placing the item in the void.

7. The method of claim 6, further comprising placing the packaging insert within an outer box before or after placing the item in the void.

8. The method of claim 1, further comprising:

folding at least a pair of sidewall panels of the packaging insert downward from the main panel;

inserting the packaging insert within an outer box so that the main panel is elevated above a support surface of the outer box via the pair of sidewall panels by a distance;

wherein folding the plurality of flaps further comprises:

selectively folding a second flap of the plurality of flaps about at least one of 1) a first bend-enhancing portion of the second flap, and 2) a second bend-enhancing portion of the second flap;

causing the inner end of the first flap and an inner end of the second flap to contact the support surface of the outer box; and placing the item in the void so that the item is supported by the first and second flaps.

9. The method of claim 8, wherein:

folding the plurality of flaps further comprises, before placing the item in the void:

selectively folding each of a pair of side flaps of the plurality of flaps downward about at least one of 1) a first bend-enhancing portion of the respective side flap so as to expose the void, and 2) a second bend-enhancing portion of the respective side flap so as to increase a size of the void; and causing inner ends of the pair of side flaps to contact the support surface of the outer box; and placing the item in the void causes the item to be further supported by the pair of side flaps.

10. The method of claim 9, wherein selectively folding each of the pair of side flaps downward about the respective second bend-enhancing portion is performed after breaking at least one frangible portion of the main panel positioned between the first and second bend-enhancing portions of each of the pair of side flaps, respectively.

11. The method of claim 9, wherein causing the inner ends of the pair of side flaps to contact the support surface of the outer box comprises causing the pair of side flaps to each be oriented at an acute angle in a range of about 15 and about 60 degrees with respect to the support surface of the outer box.

12. The method of claim 9, wherein folding the plurality of flaps expose the void occurs before inserting the packaging insert within the outer box.

13. The method of claim 9, wherein placing the item in the void further comprises bending one or both of the pair of side flaps around the item.

* * * * *